United States Patent [19]

Freeman

[11] Patent Number: 4,469,174

[45] Date of Patent: Sep. 4, 1984

[54] COMBINATION CEMENTING SHOE AND BASKET

[75] Inventor: Tommie A. Freeman, Duncan, Okla.

[73] Assignee: Halliburton Company, Duncan, Okla.

[21] Appl. No.: 466,185

[22] Filed: Feb. 14, 1983

[51] Int. Cl.[3] ..... E21B 33/136

[52] U.S. Cl. ..... 166/202; 166/285; 166/317; 166/318

[58] Field of Search ..... 166/317, 318, 202, 285, 166/325, 327, 328

[56] References Cited

U.S. PATENT DOCUMENTS

| | | | |
|---|---|---|---|
| 2,602,511 | 7/1952 | Johnson | 166/202 |
| 2,605,846 | 8/1952 | Van Brant | 166/202 |
| 2,735,498 | 2/1956 | Muse | 166/317 |
| 2,751,022 | 6/1956 | Baker et al. | 166/317 |
| 2,888,078 | 5/1959 | Lebourg | 166/202 |
| 3,148,731 | 9/1964 | Holden | 166/318 |
| 3,428,128 | 2/1961 | Jones | 166/202 |
| 3,955,625 | 5/1976 | Hughes | 166/202 |
| 3,995,692 | 12/1976 | Seitz | 166/318 |

OTHER PUBLICATIONS

Halliburton Services Sales and Service Catalog No. 41, pp. 3865, 3851-3852, and 3871.

*Primary Examiner*—William F. Pate, III

*Attorney, Agent, or Firm*—Joseph A. Walkowski; Thomas R. Weaver

[57] ABSTRACT

A combination cementing shoe and basket, comprising a substantially tubular mandrel having a cement basket disposed thereabout, the cement basket being maintained in a collapsed mode by an annular overshot at the bottom of a coupling at the top of the mandrel. A flapper valve assembly is located within the mandrel, being maintained in an open mode by the presence of a fillup tube disposed in the valve orifice. The bottom of the fillup tube is secured to a slidable ball seat located below the flapper valve assembly. The ball seat is initially secured in place by attachment through a plurality of shear rods to a tubular activating sleeve disposed around the mandrel and under the cement basket, the activating sleeve being maintained in its initial position by contact with the bottom of the cement basket, which is fixed to the mandrel by a shear screw. To operate the apparatus, a tripping ball is pumped down the casing to the ball seat, whereupon the casing pressure would cause the basket shear rods, acted upon by the activating sleeve, to shear, the basket moving downward and out from under the coupling overshot. Continued application of pressure causes the activating sleeve screw to shear, allowing the ball seat to move to the bottom of the mandrel, and removing the fillup tube from the flapper valve orifice, permitting the flapper to close.

20 Claims, 4 Drawing Figures

COMBINATION CEMENTING SHOE AND BASKET

BACKGROUND OF THE INVENTION

It is conventional practice in the oil and gas industry to cement casing in well bores. The cement is placed in the annulus between the casing and the well bore wall, and is intended to secure and support the casing in the well bore and to isolate various formations from one another by preventing migration of formation fluids up and down the well bore. The cement is generally pumped down the casing interior, out into the well bore annulus, and back up toward the surface to the desired level. There are numerous techniques and apparatus employed in "cementing," as it is termed, one of the most common being to place a cement basket at or near the lowest end of the casing, and to introduce cement into the well bore annulus immediately above the basket, the basket keeping the cement from travelling below the end of the casing to a lower formation, a particularly undesirable result if the lower formation is a low pressure or soft formation, easily damaged by the hydrostatic pressure of the cement being pumped into the annulus.

Prior art cement baskets and devices incorporating such baskets lack the capability to automatically fill the casing as it is lowered into the well bore, thus causing excessive "float" of the casing as it is supported by the well bore fluid, usually drilling mud. Furthermore, the prior art cement baskets in general use require that an additional prior art device, the cementer or cementing collar, be placed above the basket in the casing string in order to place the cement outside the casing. Another prior art device, a separate "float collar" or "float shoe" is required if the operator desires to control the fill rate of the casing as it is floated into the well bore. In addition, the cement baskets of the prior art devices are retained in a collapsed mode as the casing is run into the well by a tie band around the top of the basket, which band is supposed to release and permit the basket to expand when the cementing operation is commenced. However, at cementing rates below six to eight barrels per minute, the tie band often fails to completely release, thus preventing the basket from opening freely and allowing the cement to travel downward to the formation below the basket, damaging that formation as well as rendering the casing cement job incomplete.

SUMMARY OF THE INVENTION

In contrast to the prior art, the combination cementing shoe and basket of the present invention provides for automatic fillup of the casing as it is lowered into the well bore, and assures the complete release of the cement basket for expansion against the well bore wall by contact with the cement stream being pumped into the well bore annulus, thus preventing formation damage below.

The combination cementing shoe and basket of the present invention comprises a substantially tubular mandrel having a cement basket slidably disposed on the exterior thereof. The lower end of the basket is secured to the mandrel by shear screws, and the upper end of the basket is maintained in a closed mode by an annular overshot on the coupling at the upper end of the mandrel. A flapper valve assembly is located within the mandrel, with a slidable ball seat disposed therebelow, the ball seat having fixed thereto a fillup tube which extends upward into the flapper valve orifice. The ball seat is secured to a substantially tubular activating sleeve slidably disposed on the exterior of the mandrel, under the cement basket, by a plurality of shear rods extending through cementing ports in the mandrel. The activating sleeve is maintained in its initial position by contact with the bottom of the cement basket. As the casing is lowered into the well bore with the combination cementing shoe and basket of the present invention at its lower end, the casing fills automatically through an orifice in the nose at the bottom of the mandrel, due to the fact that the flapper valve is held open by the fillup tube. The orifice size can be easily changed or selected for varying well conditions and desired rate of fillup. After the casing reaches the desired depth, a tripping ball is pumped down through the casing to the ball seat, whereupon the fluid pressure acts through the plurality of shear rods, and the activating sleeve on the lower end of the cementing basket to shear the shear screw. The shearing of the latter permits the cement basket to slide downward, the top thereof being thereby freed from the coupling overshot. Continuance of fluid pressure in the casing results in the plurality of shear rods being sheared, and the ball, ball seat and fillup tube moving to the bottom of the mandrel, releasing the valve flapper and uncovering the cementing ports in the mandrel wall. The subsequent introduction of the cement stream under pressure into the well bore annulus through the cementing ports expands the cement basket by direct contact therewith, preventing damage to the formation below. At the conclusion of the cementing operation, the flapper valve prevents the cement from flowing back into the casing interior. After the cement has set, the interior components of the apparatus of the present invention can be drilled out.

BRIEF DESCRIPTION OF THE DRAWINGS

The combination cementing shoe and basket of the present invention will be better understood by reference to the following detailed descriptions of its construction and operation, taken in conjunction with the appended drawings wherein.

DETAILED DESCRIPTION AND OPERATION OF THE PREFERRED EMBODIMENT

Figure 1:
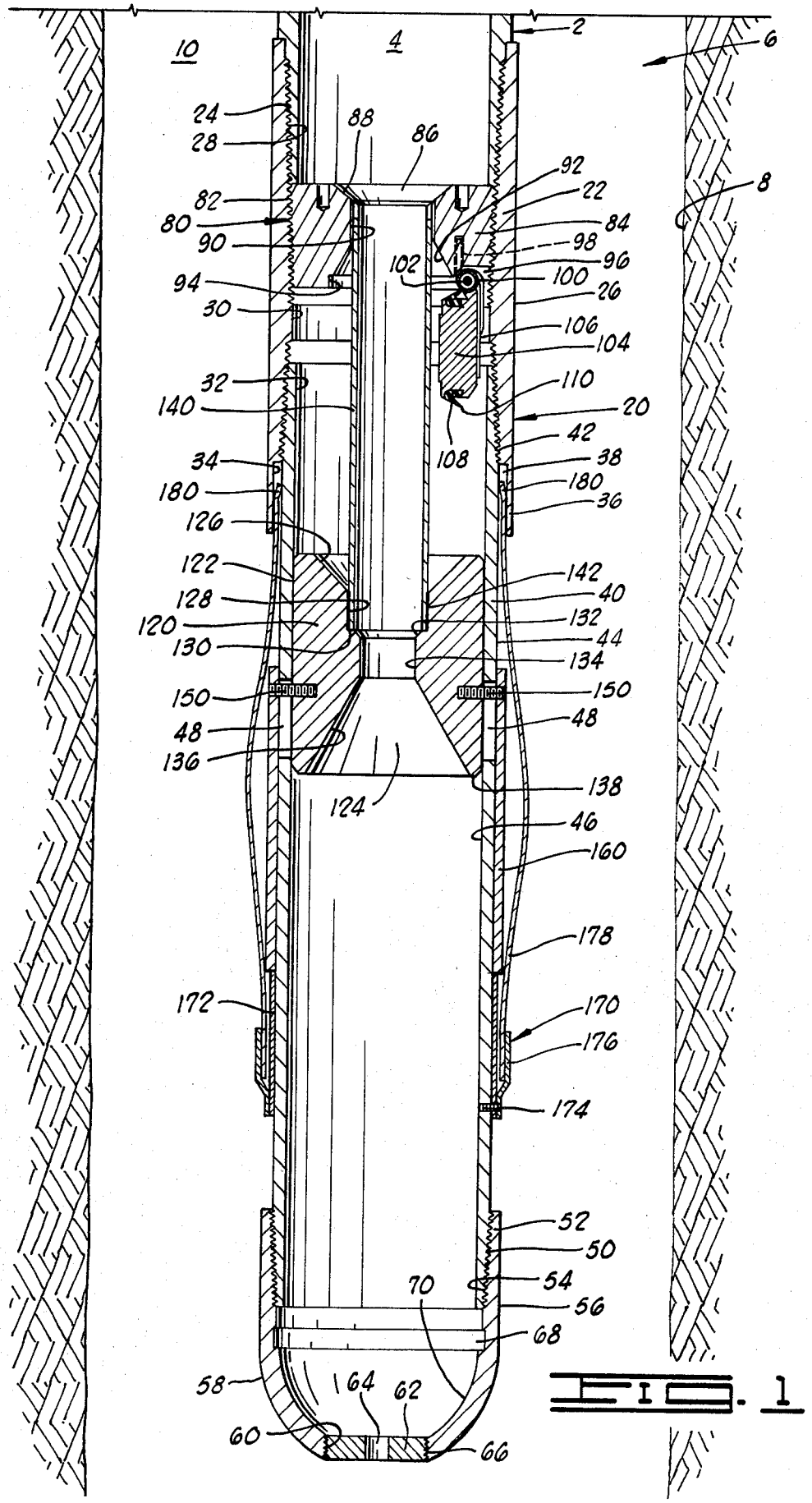
FIG. 1 is a vertical full section elevation of the combination cementing shoe and basket of the present invention as it is run into the well bore at the end of a casing string.

A detailed description is made hereafter with reference to FIG. 1 of the drawings, wherein casing string 2 having bore 4 is being lowered into well bore 6 defined by well bore wall 8. Well bore annulus 10 lies between casing string 2 and well bore wall 8.

The combination cementing shoe and basket 20 of the present invention is lowered into well bore 6 at the end of casing string 2 being secured thereto by coupling 22 at threads 24. Coupling 22 possesses a substantially cylindrical exterior 26, its interior having upper internal threads 28 separated from lower internal threads 32 by unthreaded cylindrical surface 30. Below lower internal threads 32 lies annular undercut surface 34 of greater interior diameter than threads 32, which undercut extends to the bottom of coupling 22.

Tubular mandrel 40 is secured to coupling 22 above it via external threads 42 which mate with lower internal threads 32. As the exterior 44 of mandrel 40 is of somewhat lesser diameter than undercut surface 34 of coupling 22, the overshot bottom 36 of coupling 22 defines annular recess 38 which is open at its bottom. Tubular mandrel 40 has a substantially cylindrical interior 46. Mandrel 40 is pierced by a plurality of circumferentially spaced slots 48 near its upper end. The bottom of mandrel 40 has external threads 50 thereon, which mate with internal threads 54 at the top of nose 52, which has a substantially cylindrical exterior surface 56 leading to substantially hemispherical bottom surface 58, in which an aperture has been cut and the aperture walls threaded at 60. Orifice plate 62 having orifice 64 therein and threads 66 on its perimeter is threaded to nose 52. The upper interior wall of nose 52 below threads 54 has annular recess 68 cut therein, below which inner surface 70 follows the curvature of hemispherical bottom surface 58.

At the top of combination cementing shoe and basket 20, valve assembly 80 having external threads 82 thereon is threaded to upper internal threads 28 on coupling 22. Valve assembly 80 includes valve body 84, which possesses an axial bore 86 therethrough, bore 86 being defined by upper frustoconical bore wall 88, upper cylindrical bore wall 90, lower frustoconical bore wall 92, and lower cylindrical bore wall 94. The right-hand side (in FIG. 1) of lower cylindrical bore wall 94 has been milled away to provide recess 96. At the top of recess 96 is longitudinal bore 98, into which the end of spring 100 is inserted, spring 100 being wrapped around pin 102 from which flapper 104 is suspended by two arms (unnumbered), the intermediate portion 106 of spring 100 pressing against flapper 104 to rotationally bias it to a closed position seated against lower frustoconical bore wall 92. Flapper 104 is of circular configuration, the circumference of which posseses annular recess 108 which holds elastomeric seal 110.

Ball seat 120 is secured in mandrel 40 below valve body 84. Ball seat 120 has a substantially cylindrical exterior 122, and axial bore 124 through its interior. Bore 124 is defined by upper frustoconical surface 126, upper cylindrical surface 128 having threads thereon, radially flat surface 130 leading inward to frustoconical seat 132, lower cylindrical surface 134, and lower frustoconical surface 136, which exits on radially flat bottom surface 138 of ball seat 120. Fillup tube 140 has theads 142 at its lower end, which threads mate with those on surface 128 of ball seat 120. The top of fillup tube 140 extends upwardly into axial bore 86 of valve body 84, to the juncture of bore wall 88 and bore wall 90. Flapper 104 is maintained in an open position by fillup tube 140.

Figure 2:
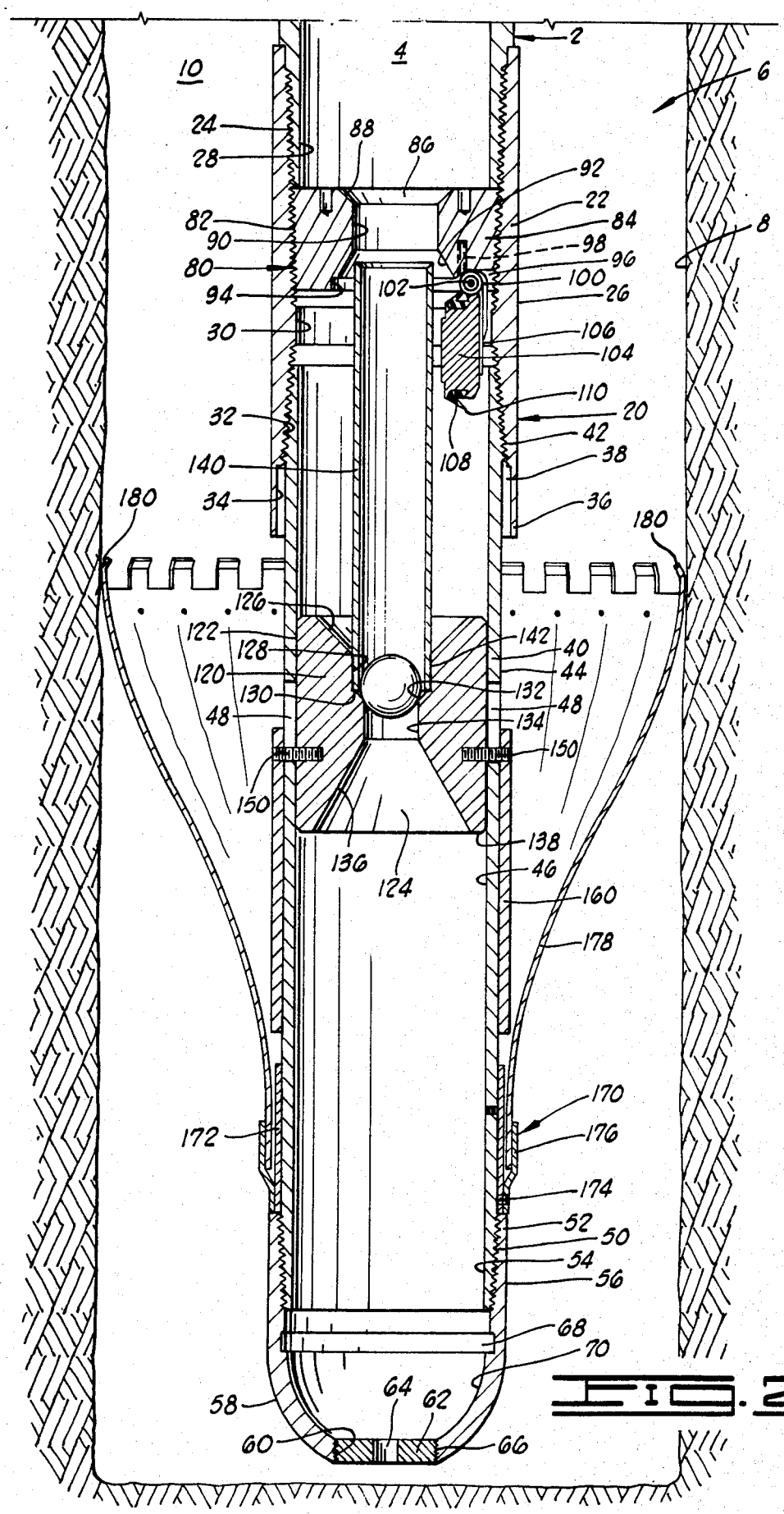
FIG. 2 is a vertical full section elevation of the present invention after the tripping ball has been dropped therein, and the basket released.

Shear rods 150 extend from ball seat 120 through slots 48 in tubular mandrel 40 into activating sleeve 160, which is also of tubular configuration. Activating sleeve 160 rests on inner sleeve 172 of cement basket 170. Inner sleeve 172 is secured to mandrel 40 by shear screw 174, which is of lesser shear strength than shear screws 150. End ring 176 is welded to inner sleeve 172, and a plurality of basket staves 178 are in turn welded to end ring 176. Heavy duty canvas 179 (not shown in FIG. 1, see FIG. 2) or other tough, abrasion and rip-resistant fabric is riveted inside staves 170 to fill the gaps between staves as cement basket 170 expands. The upper ends 180 of staves 178 are tucked under overshot 36 of coupling 22 prior to shear screw 174 being inserted. Overshot 36 thus maintains staves 178 and thus basket 170 in a collapsed state until activated.

Referring now to FIGS. 1–4, the operation of the preferred embodiment is described hereafter. As noted previously, combination cementing shoe and basket 20 is run into well bore 6 at the end of casing string 2. The well bore 6 is filled with fluid, such as drilling fluid, and the casing gradually fills as it is "floated" down into the well bore, the rate of fill being generally determined by the size orifice 64 in orifice plate 62. Flapper 104 is held open by fillup tube 140. As the casing string 2 reaches the depth desired, a weighted tripping ball 200 (FIG. 2) is dropped to combination cementing shoe and basket 20, where it enters axial bore 86 of valve assembly 80, and goes down the interior of fillup tube to frustoconical seat 132 in ball seat 120. At this point, fluid pressure is applied in casing bore 4, which acts on ball seat 120 due to the fact that tripping ball 200 is blocking bore 124. The downward force on ball seat 120 is transmitted to inner sleeve 172 through activating sleeve 160 and shear rods 150. Shear screw 174, which secures inner sleeve 172 and cement basket 170 as a whole to mandrel 40 shears, and cement basket 170 drops a longitudinal distance equal to the height of slots 48 in mandrel 40. This drop pulls basket staves 178 out from under overshot 36, whereupon they spring outward to the well bore wall 8, canvas 179 forming a frustoconical cup. The inner sleeve 172 and end ring 176 of cement basket 170 rest against the top of nose 52, which protrudes outwardly beyond mandrel 40.

Continued pressure in casing bore 4 will cause shear rods 150 to shear against the bottom of slots 48, causing ball seat 120 with ball 200 in fillup tube 140 to fall into nose 52. The removal of fillup tube 140 from axial bore 86 of valve body 84 releases flapper 104 to hold back pressure after the cementing job is finished.

Figure 3:
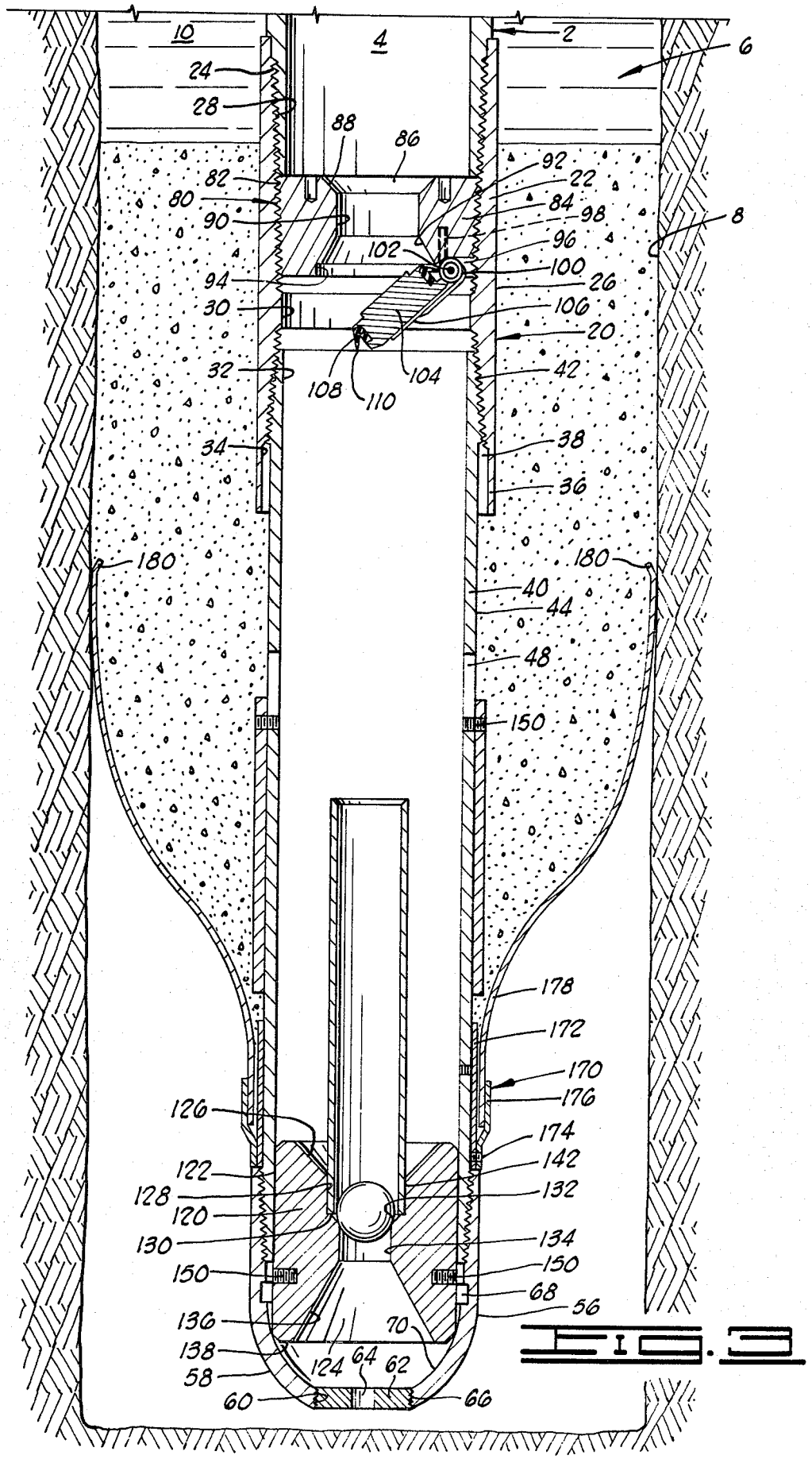
FIG. 3 is a vertical full section elevation of the present invention after the ball seat has been pumped to the bottom of the mandrel, the flapper valve released, and cement flow commenced.
Figure 4:
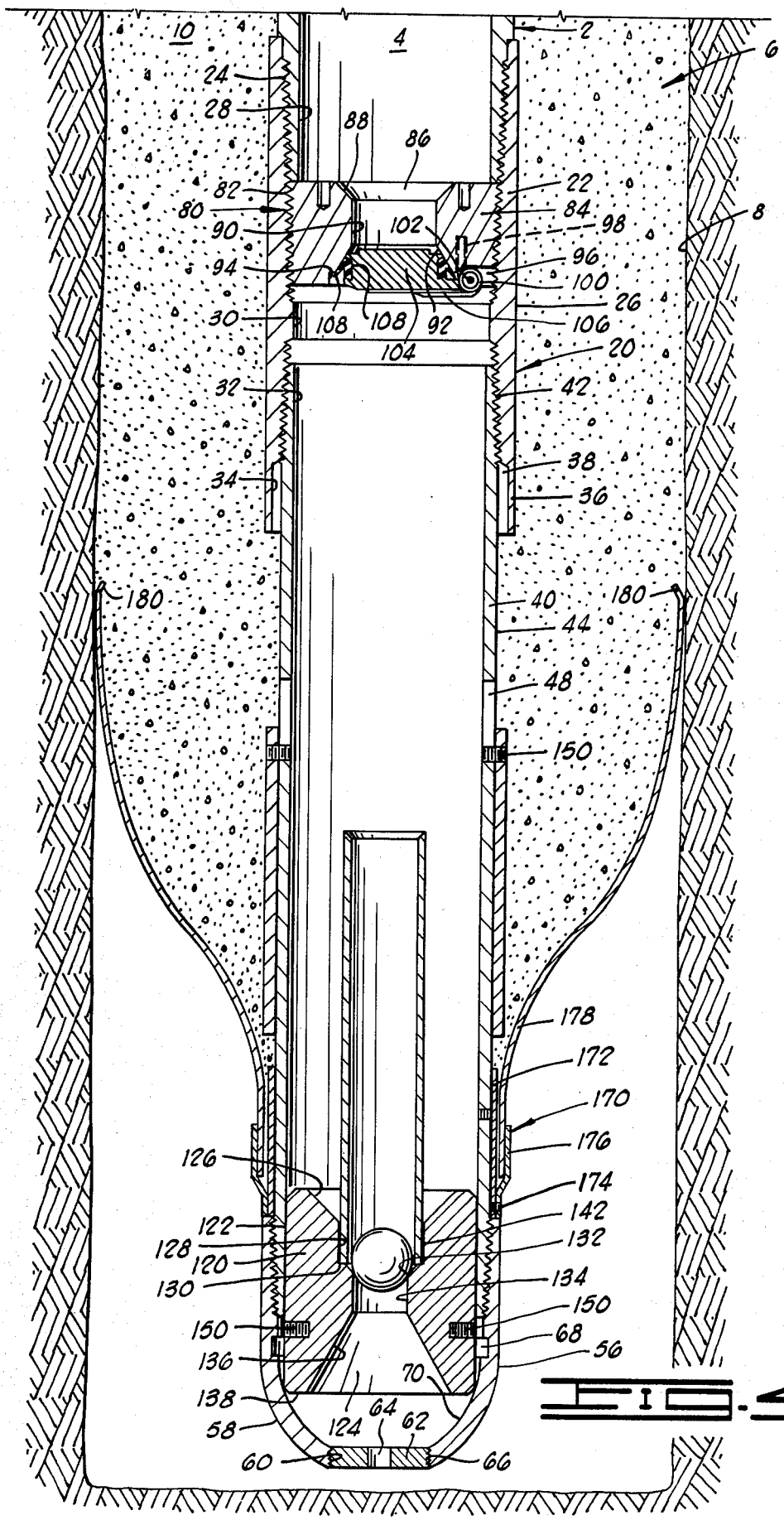
FIG. 4 is a vertical full section elevation of the present invention after cementing is completed and pumping stopped.

Cement is pumped down casing bore 4 after ball seat 120 moves down to nose 52, the cement entering well bore annulus 10 through slots 48 (FIG. 3), after which it travels upward in the annulus to the desired level, downward movement of cement being prohibited by the cement basket 170 which is expanded against well bore wall 8. The lateral contact of the cement stream through slots 48 against cement basket 170 as well as the relatively greater weight of the cement with respect to the well bore fluid, and the fluid pressure differential above and below the cement basket 170 will ensure its complete expansion (FIGS. 3 and 4). For purposes of clarity, cement has not been shown inside the tool 20 in any view even though it would obviously be full of cement in FIGS. 3 and 4.

After cementing is finished and the pumping is stopped, reentry of cement into casing bore 4 is prevented by flapper 104 sealing against surface 92 with the assistance of elastomeric seal 110 at its periphery. After the cement in annulus 10 hardens, all interior components of combination cementing shoe and basket 20 can be drilled out, leaving an open bore of substantially the same inner diameter as casing string 2.

Thus it will be apparent to one of ordinary skill in the art that a novel and unobvious combination cementing shoe and basket has been invented, having the capability to replace three existing prior art devices and to overcome the disadvantages thereof. In particular, the advantages of the present invention include the removal of the need for a tie band gives a significant advantage over prior art cement baskets, and the avoidance of the need for a prior art cementing collar as well as a shutoff plug such as is needed in those prior art cementing collars, and the avoidance of the need for a float valve. It will further be understood by one of ordinary skill in the art that the present invention may be used in more than one location in a casing string, as long as the ball and ball seat size of each lower tool is smaller than that of the one immediately above it.

Certain additions, deletions and modifications to the present invention as disclosed herein in its preferred embodiment will also be apparent to one of ordinary skill in the art. For example, a cement basket employing overlapping staves or leaves might be employed in the present invention; the present invention might be configured as a collar instead of a shoe and placed further up in the casing string if desired. A rod secured to the ball seat and extending upward into the valve assembly bore may be employed in lieu of the fillup tube to initially maintain the flapper in an open position. These and many other modifications, of course, could be made without departing from the spirit and scope of the present invention as set forth in the appended claims:

I claim:

1. A combination cementing shoe and basket, comprising:

tubular mandrel means having an exterior annular overshot, and a plurality of circumferentially spaced slots through the wall thereof;

cement basket means having end ring means and a plurality of upwardly extending stave means, said cement basket means surrounding said mandrel means and secured thereto by shear means associated with said end ring means of said cement basket means, so that the upper ends of said stave means extend under said overshot;

flapper valve means having an axial bore therethrough and a spring-biased flapper, said flapper means being secured to the interior of said mandrel means;

ball seat means slidably disposed within said mandrel means below said flapper valve means, said ball seat means having an axial bore therethrough with a ball seat therein, and shear means extending therefrom through said slots into tubular activating sleeve means surrounding said mandrel means under said cement basket means between said overshot and said end ring means; and fillup tube means secured to said ball seat means in said axial bore thereof and extending upward therefrom into said flapper valve means bore.

2. The combination cementing shoe and basket of claim 1, wherein said tubular mandrel means comprises a tubular mandrel having a coupling secured to the top thereof, said coupling having a downward extending annular overshot at the lower end thereof protruding over the exterior of said mandrel.

3. The combination cementing shoe and basket of claim 2, wherein said mandrel means further comprises a nose means at the bottom thereof, said nose means having an orifice therethrough.

4. The combination cementing shoe and basket of claim 3, wherein said orifice is in a removable orifice plate in said nose, whereby the size of said nose orifice may be varied by replacement of said orifice plate.

5. The combination cementing shoe and basket of claim 2, wherein said flapper valve means is secured to said coupling at the top of said mandrel, and further includes frustoconical flapper seat means in said axial bore, said flapper of said flapper valve means being rotationally upwardly biased toward contact with said flapper seat means.

6. The combination cementing shoe and basket of claim 1, wherein said ball seat is a frustoconical surface located below the end of said fillup tube means.

7. The combination cementing shoe and basket of claim 1, wherein said cement basket means further includes fabric means secured to and extending between said stave means, whereby a generally frustoconical cup is defined when said stave means are in an expanded mode.

8. The combination cementing shoe and basket of claim 7, wherein said stave means are welded to the inside of an end ring of said end ring means, and said end ring is welded at its lower extent to an inner sleeve closely surrounding said mandrel means.

9. The combination cementing shoe and basket of claim 8, wherein said activating sleeve means rests upon said inner sleeve.

10. The combination cementing shoe and basket of claim 1, wherein said fillup tube means comprises a fillup tube threaded to the interior of said ball seat means bore above said ball seat.

11. The combination cementing shoe and basket of claim 1, wherein said mandrel means further comprises a nose means at the bottom thereof, said nose means having an orifice therethrough.

12. The combination cementing shoe and basket of claim 1, wherein said orifice is in a removable orifice plate in said nose, whereby the size of said nose orifice may be varied by replacement of said orifice plate.

13. A combination cementing shoe and basket for use in a casing string in a well bore, comprising:

a tubular coupling having an annular overshot at its lower extent;

a flapper valve assembly secured to the interior of said coupling, said flapper valve assembly including a spring-biased flapper and an axial bore through said assembly, said flapper being rotationally upwardly biased to a closed position over said bore;

a tubular mandrel secured to the interior of said coupling below said flapper valve assembly, said mandrel being of smaller outside diameter than said coupling overshot which extends thereover, said mandrel having circumferentially spaced slots therein;

a ball seat assembly having an axial bore therethrough and a ball seat in said bore, slidably disposed in said mandrel and having associated therewith shear rods extending through said slots into a tubular activating sleeve surrounding said mandrel;

a fillup tube secured at its bottom in said ball seat axial bore above said ball seat, the top of said fillup tube extending into said flapper valve assembly axial bore; and a cement basket surrounding said mandrel and said activating sleeve, said cement basket including a plurality of staves, the tops of which extend under said coupling overshot, and the bottoms of which are secured to an end ring below said activating sleeve, which end ring is secured to said mandrel by a shear screw.

14. The combination cementing shoe and basket of claim 13, further including a nose secured to the bottom of said mandrel, said nose having an orifice therein.

15. The combination cementing shoe and basket of claim 14, wherein said nose further includes a removable orifice plate having said orifice therein, whereby the size of said orifice may be varied.

16. The combination cementing shoe and basket of claim 13, wherein said cement basket further includes a fabric web within said staves, said web adapted to form a generally frustoconical cup upon release of said staves from said overshot, whereby cement may be contained above said cement basket between said combination cementing shoe and basket and the wall of said well bore.

17. A cementing apparatus comprising:

tubular mandrel means including exterior annular overshot means, and a plurality of apertures extending through the wall thereof;

flexible cement basket means of generally frustoconical configuration surrounding said mandrel means and being shearably secured thereto, the upper extent of said cement basket means extending under said overshot, whereby said cement basket means is maintained in a substantially collapsed state against said mandrel means;

ball seat means having an axial bore therethrough slidably disposed within said mandrel means;

longitudinally slidable activating sleeve means surrounding said mandrel means under said cement basket means;

connection means extending through said mandrel apertures between said ball seat means and said activating sleeve means.

18. The apparatus of claim 17, wherein said connecting means is shearable.

19. The apparatus of claim 18, further including valve means secured to the interior of said mandrel means above said ball seat means, said valve means having an axial bore therethrough and spring-biased closure means associated with said bore; and fillup tube means extending upward from said ball seat means bore into said valve means bore.

20. The apparatus of claim 17, wherein said closure element comprises a valve flapper, and said ball seat means includes an annular ball seat proximate the bottom of said fillup tube means.

* * * * *